US010642191B1

(12) United States Patent
Zhu et al.

(10) Patent No.: US 10,642,191 B1
(45) Date of Patent: May 5, 2020

(54) DEVELOPER CONTAINER

(71) Applicant: JIANGXI KILIDER TECHNOLOGY CO., LTD., Shangrao (CN)

(72) Inventors: Jinjun Zhu, Shangrao (CN); Zhongxi Li, Shangrao (CN); Jiabing He, Shangrao (CN)

(73) Assignee: JIANGXI KILIDER TECHNOLOGY CO., LTD., Shangrao (CN)

( * ) Notice: Subject to any disclaimer, the term of this patent is extended or adjusted under 35 U.S.C. 154(b) by 0 days.

(21) Appl. No.: 16/595,517

(22) Filed: Oct. 8, 2019

(30) Foreign Application Priority Data

Sep. 24, 2019 (CN) ..... 2019 1 0895742

(51) Int. Cl.
*G03G 15/08* (2006.01)
*G03G 21/18* (2006.01)

(52) U.S. Cl.
CPC ..... *G03G 15/0889* (2013.01); *G03G 15/0822* (2013.01); *G03G 15/0875* (2013.01); *G03G 15/0877* (2013.01); *G03G 15/0886* (2013.01); *G03G 15/0891* (2013.01); *G03G 21/186* (2013.01); *G03G 21/1857* (2013.01); *G03G 2215/066* (2013.01); *G03G 2215/068* (2013.01); *G03G 2215/0634* (2013.01); *G03G 2215/0692* (2013.01); *G03G 2215/0802* (2013.01); *G03G 2215/0816* (2013.01)

(58) Field of Classification Search
CPC ..... G03G 15/0889; G03G 15/0877; G03G 15/0822; G03G 15/0886; G03G 15/0891; G03G 15/0875; G03G 21/1857; G03G 21/186; G03G 2215/0634; G03G 2215/0692; G03G 2215/066; G03G 2215/068; G03G 2215/0816; G03G 2215/0802
See application file for complete search history.

(56) References Cited

U.S. PATENT DOCUMENTS 4,721,982 A * 1/1988 Ueda ..... G03G 15/0822 399/254
6,091,920 A * 7/2000 Kita ..... G03G 15/0872 399/262
7,236,726 B2 * 6/2007 Mori ..... G03G 15/0875 399/252
7,697,871 B2 * 4/2010 Eto ..... G03G 15/0868 399/120
8,380,117 B2 * 2/2013 Ohta ..... G03G 21/12 399/360

(Continued)

*Primary Examiner* — Ryan D Walsh

(57) ABSTRACT

The present disclosure provides a developer container including a developer supplying box and a developer containing box. A first gear is rotatably connected to the developer supplying box, and a rotating shaft is inserted into the first gear; first stirring blades are fixed to two sides of the rotating shaft, and a second stirring blade is fixed at the rotating shaft; a first sliding cover is sleeved on the developer supplying box, and a sliding cover powder outlet is disposed on the first sliding cover; a supply box powder outlet is disposed on the developer supplying box; the first gear is engaged with a second gear, the second gear is engaged with a third gear, the third gear is engaged with a fourth gear, and the fourth gear is engaged with a fifth gear; and a screw feeding rod is inserting into the fifth gear.

8 Claims, 7 Drawing Sheets

(56) References Cited

U.S. PATENT DOCUMENTS

| | | | | |
|---|---|---|---|---|
| 8,588,661 | B2 * | 11/2013 | Ota | G03G 15/0877 399/263 |
| 8,983,358 | B2 * | 3/2015 | Ota | G03G 21/12 399/360 |
| 2010/0329734 | A1 * | 12/2010 | Hayakawa | G03G 15/0896 399/119 |
| 2014/0205328 | A1 * | 7/2014 | Ota | G03G 15/0886 399/260 |
| 2015/0301480 | A1 * | 10/2015 | Okuda | G03G 15/0889 399/263 |
| 2018/0052408 | A1 * | 2/2018 | Eto | G03G 15/0875 |
| 2018/0088508 | A1 * | 3/2018 | Kawada | G03G 15/556 |

* cited by examiner

DEVELOPER CONTAINER

REFERENCE TO RELATED APPLICATION PROGRAMS

This application claims priority to Chinese Patent Application No. CN 201910895742.8, filed Sep. 24, 2019, which is hereby incorporated by reference herein as if set forth in its entirety.

BACKGROUND

1. Technical Field

The present disclosure relates to developer container technology, and particularly to a developer container.

2. Description of Related Art

Developer refers to a chemical for making latent images produced by the photosensitive material after exposure to form visible images. From the viewpoint of chemical components, developers can be classified into two major categories of inorganic compounds and organic compounds. The imaging of an image forming apparatus such as a copier or a printer cannot be realized without developer. Generally, the electrophotographic type image forming apparatus such as electrophotographic copiers use fine-particle type developers. In such an image forming apparatus, as a developer is consumed in the image forming process, it is necessary to replenish the developer using a developer supply container.

An image forming apparatus includes a carrier, a developing device, a developer supply container, and a storage container. However, in using the conventional developer supply container, since the developer outlet is located at the center portion, in order to cause the developer to flow to the center portion of the developer supply container, a developer stirring rod is disposed in a developer tank of the supply container. However, the developer stirring rod has some defects in its shape, which is not easy to be processed. In addition, in the process of stirring the developer, it is easy to cause the overall torque to be too large, which results in the unsmooth discharge of the developer. At the same time, in the conventional developer supply container, since two ends of the developer stirring rod has a positioning hole matching a shaft, which will cause uneven force during the process of stirring. To this end, a new type of developer container is proposed to solve the problems in the prior art.

SUMMARY

An object of the present disclosure is to provide a developer container to solve the above-mentioned problems in the prior art that, in using the conventional developer supply container, since the developer outlet is located at the center portion, in order to cause the developer to flow to the center portion of the developer supply container, a developer stirring rod is disposed in a developer tank of the supply container. However, the developer stirring rod has some defects in its shape, which is not easy to be processed. In addition, in the process of stirring the developer, it is easy to cause the overall torque to be too large, which results in the unsmooth discharge of the developer. At the same time, in the conventional developer supply container, since two ends of the developer stirring rod has a positioning hole matching a shaft, which will cause uneven force during the process of stirring.

In order to achieve the above-mentioned object, the present disclosure provides the following technical solution: a developer container including a developer supplying box and a developer containing box, where the developer supplying box is inserted to fix at an upper end of the developer containing box; a first gear is rotatably connected to an outer side of a side wall of the developer supplying box, and a rotating shaft is inserted into the first gear, the rotating shaft is located inside the developer supplying box, a plurality of first stirring blades are fixedly connected to two sides of the rotating shaft in a symmetrical manner, and a second stirring blade is fixed at a middle portion of the rotating shaft; a first sliding cover is sleeved on a middle portion of an outer side of the developer supplying box, and a sliding cover powder outlet is disposed on a front side of the first sliding cover; a supply box powder outlet is disposed on a middle portion of a front side of the developer supplying box to match the sliding cover powder outlet; a lower side of the first gear is engaged with a second gear to form a transmission connection, a lower side of the second gear is engaged with a third gear to form a transmission connection, a side of the third gear is engaged with a fourth gear to form a transmission connection, and a lower side of the fourth gear is engaged with a fifth gear to form a transmission connection, a screw feeding rod is inserting into the fifth gear, and the screw feeding rod is located in a middle portion inside the developer containing box.

In one embodiment, an end of the rotating shaft away from the first gear is provided with a ring, a side cover is rotatably connected with the ring, and the side cover is fixed on an outer wall of the developer supplying box.

In one embodiment, a plug is inserted into a middle portion of the side cover, a sealing ring is sleeved on the plug, and the sealing ring closely contacts with the side cover.

In one embodiment, a powder waste inlet is disposed on a side of the developer containing box adjacent to the fifth gear, the second sliding cover is slidably connected to an outer side of the powder waste inlet, and the second sliding cover is disposed on the developer containing box.

In one embodiment, a sixth gear is fixed to an end of the screw feed rod away from the fifth gear, the sixth gear is located at an outer side of the developer containing box and is rotatably connected to a side wall of the developer containing box, and a side of the sixth gear is engaged with a seventh gear to form a transmission connection, a side of the seventh gear is engaged with an eighth gear to form a transmission connection, a connecting rod is fixed with the eighth gear, a rocker arm is fixed to an end of the connecting rod away from the eighth gear, a detection cover covers an outer side of the rocker arm, the detection cover is fixed to an outer wall of the developer containing box, and a detection opening is formed at an end of the detection cover.

In one embodiment, a position limiter is integrally formed on an outer wall of the developer supplying box, and a chuck matching the position limiter is integrally formed on the first sliding cover.

In one embodiment, an outer wall of the first sliding cover is provided with anti-slip patterns in an even manner.

In one embodiment, the first stirring blades on the two sides of the rotating shaft are symmetrically disposed to have included angles opposite with each other with respect to an axis of a body of the rotating shaft between two corresponding first stirring blades, and the second stirring blade is disposed parallel to the axis of the body of the rotating shaft.

In comparison with the prior art, the developer container provided by the present disclosure has the following advantages: through rotatably disposing the rotating shaft inside the developer supplying box, symmetrically fixing the first stirring blades to the two sides of the rotating shaft, and fixing the second stirring blade at the middle portion of the rotating shaft. Since the first stirring blades on the two sides have included angles opposite with each other with respect to the axis of the body of the rotating shaft, and the second stirring blade in the middle portion is disposed parallel to the axis of the body of the rotating shaft, the rotating shaft will drive the first stirring blades and the second stirring blade to rotate inside the developer supplying box so that the first stirring blades convey the developer in the developer supplying box from the two ends to the middle and then reaches the supply box powder outlet, so as to supply the developer to an image forming apparatus. The structures of the rotating shaft, the first stirring blades, and the second stirring blade are simple and convenient for assembly and processing. Besides, one end of the rotating shaft far from the first gear is fixed with the ring which rotates with the side cover, thereby fix the direction so that the forces acting on the rotating shaft can be even.

BRIEF DESCRIPTION OF THE DRAWINGS

To describe the technical schemes in the embodiments of the present disclosure more clearly, the following briefly introduces the drawings required for describing the embodiments or the prior art. Apparently, the drawings in the following description merely show some examples of the present disclosure. For those skilled in the art, other drawings can be obtained according to the drawings without creative efforts.

DETAILED DESCRIPTION

The technical solutions in the embodiments of the present disclosure will be clearly and completely described below in conjunction with the drawings in the embodiments of the present disclosure. Apparently, the following embodiments are only part of the embodiments of the present disclosure, not all of the embodiments of the present disclosure. The embodiments described herein are merely for illustrating the present disclosure and are not intended to limit the present disclosure. All other embodiments obtained by those skilled in the art without creative efforts are within the scope of the present disclosure.

Figure 1:
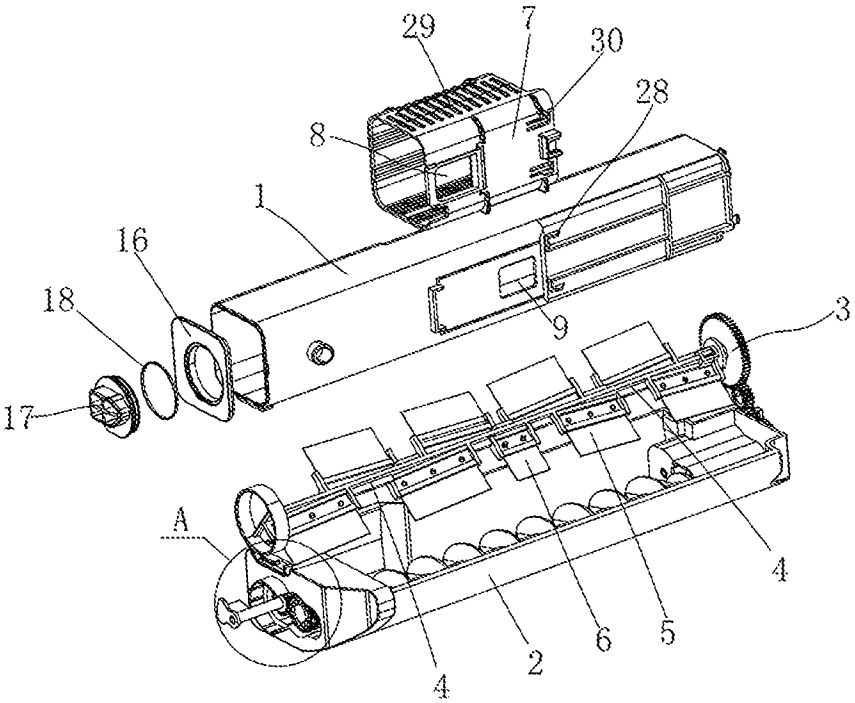
FIG. 1 is an exploded view of the structure of an embodiment of a developer container according to the present disclosure.
Figure 2:
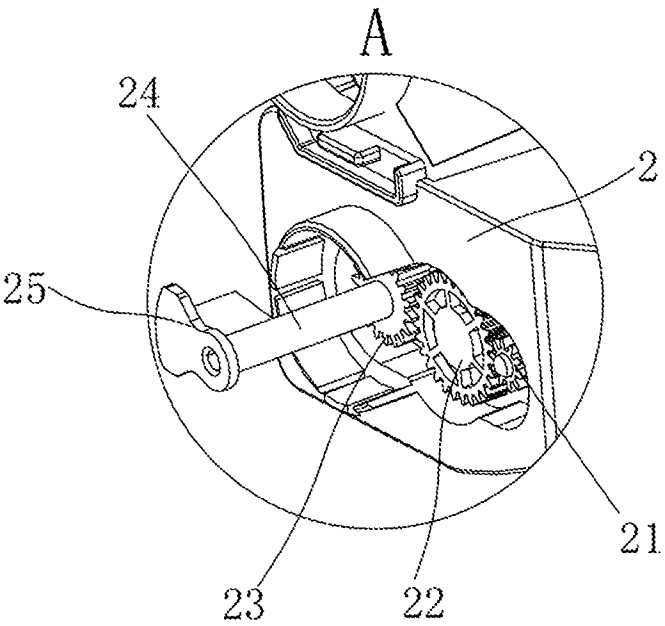
FIG. 2 is an enlarged view of the part A of FIG. 1.
Figure 3:
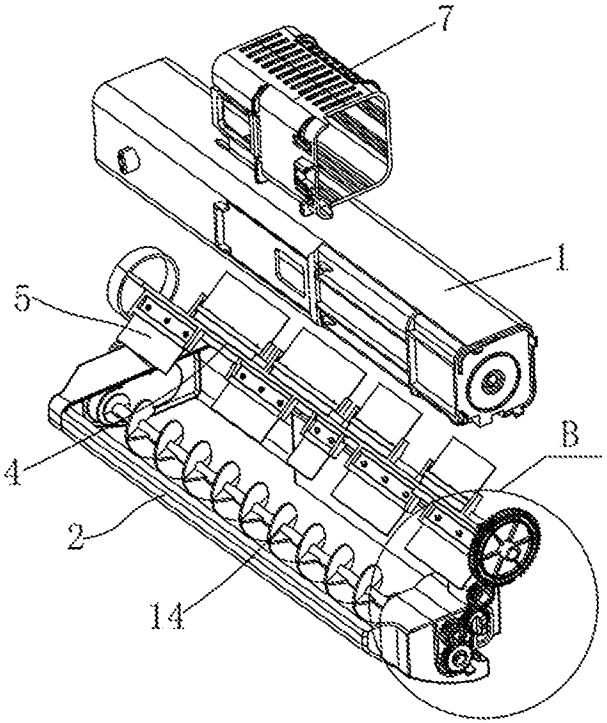
FIG. 3 is another exploded view of the structure of the developer container of FIG. 1.
Figure 4:
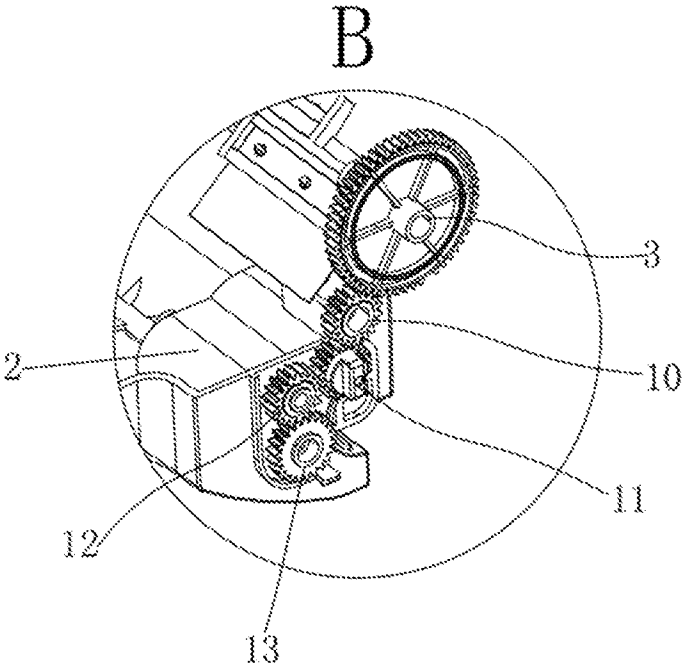
FIG. 4 is an enlarged view of the part B of FIG. 3.

As shown in FIG. 1 and FIG. 2, a developer container is provided, which includes a developer supplying box 1 and a developer containing box 2. The developer supplying box 1 is inserted to fix at an upper end of the developer containing box 2; a first gear 3 is rotatably connected to an outer side of a side wall of the developer supplying box 1, and a rotating shaft 4 is inserted into the first gear 3. The rotating shaft 4 is located inside the developer supplying box 1, first stirring blades 5 are fixedly connected to two sides of the rotating shaft 4 in a symmetrical manner, and a second stirring blade 6 is fixed at a middle portion of the rotating shaft 4. In which, the first stirring blades 5 on the two sides of the rotating shaft 4 are symmetrically disposed to have included angles opposite with each other with respect to an axis of a body of the rotating shaft 4 between two corresponding first stirring blades 5, and the second stirring blade 6 is disposed parallel to the axis of the body of the rotating shaft 4. The rotating shaft 4 will drive the first stirring blades 5 and the second stirring blade 6 to rotate inside the developer supplying box 1 so that the first stirring blades 1 convey the developer in the developer supplying box 1 from the two ends to the middle and then reaches the supply box powder outlet 9, so as to supply the developer to an image forming apparatus. The structures of the rotating shaft 4, the first stirring blades 5, and the second stirring blade 6 are simple and convenient for assembly and processing.

Figure 6:
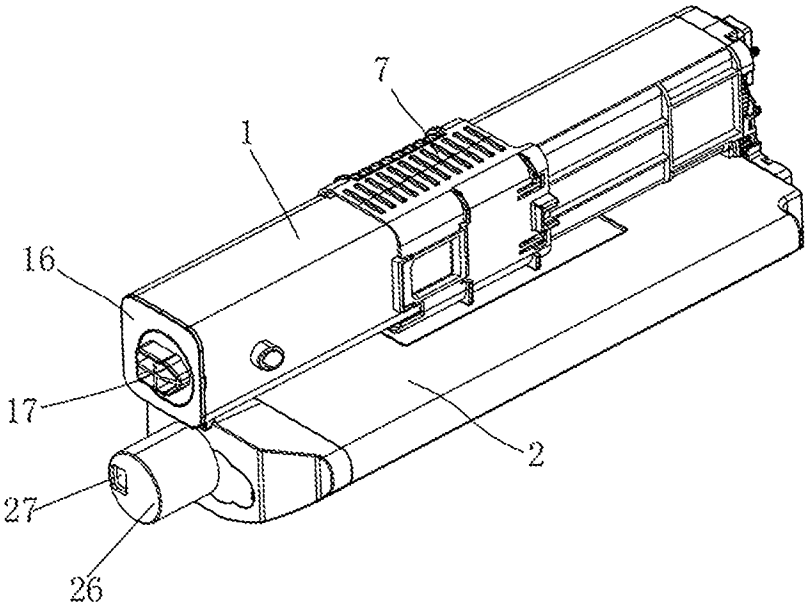
FIG. 6 is another perspective view of the developer container of FIG. 1.
Figure 7:
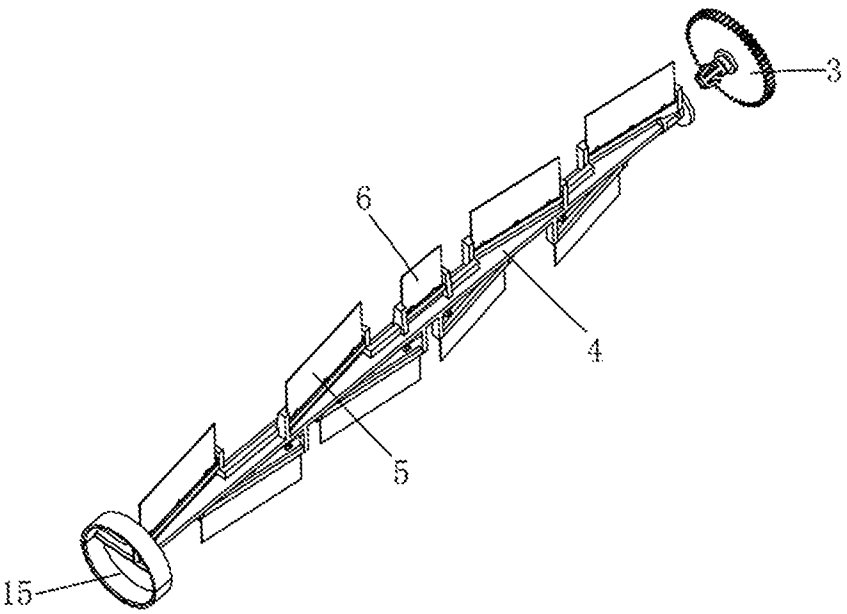
FIG. 7 is a schematic diagram of the structure of the rotating shaft, the first stirring blades and the second stirring blade of the developer container of FIG. 1.

As shown in FIG. 1, FIG. 6, and FIG. 7, an end of the rotating shaft 4 away from the first gear 3 is provided with a ring 15, a side cover 16 is rotatably connected with the ring 15, and the side cover 16 is fixed on an outer wall of the developer supplying box 1. The side cover 16 cooperates with the ring 15 to fix the direction, so that the forces acting on the rotating shaft 4 can be even. A plug 17 is inserted into a middle portion of the side cover 16, a sealing ring 18 is sleeved on the plug 17, and the sealing ring 18 closely contacts with the side cover 16 to provide a sealing function to prevent the developer from leaking.

Figure 5:
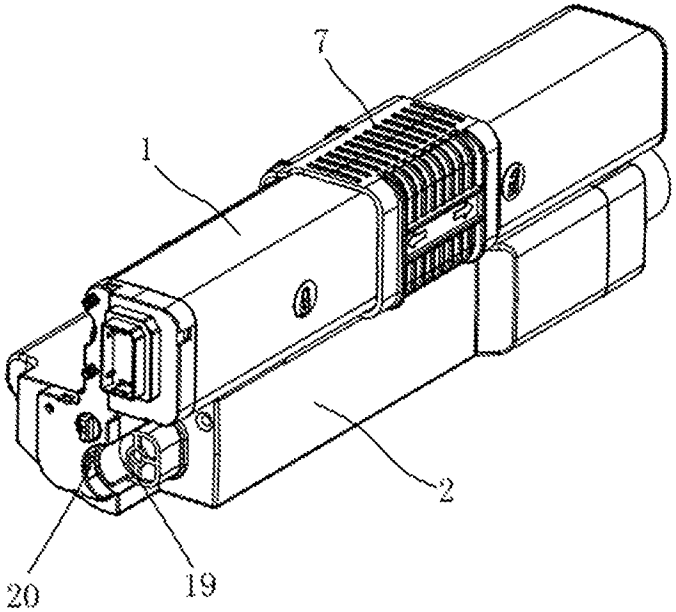
FIG. 5 is a perspective view of the developer container of FIG. 1.

As shown in FIG. 1 and FIG. 5, a first sliding cover 7 is sleeved on a middle portion of an outer side of the developer supplying box 1. In order to increase the friction between the hand of the user and the first sliding cover 7, an outer wall of the first sliding cover 7 is provided with anti-slip patterns 29 in an even manner, so as to facilitate the sliding of the first sliding cover 7. A sliding cover powder outlet 8 is disposed on a front side of the first sliding cover 7, and a supply box powder outlet 9 is disposed on a middle portion of a front side of the developer supplying box 1 to match the sliding cover powder outlet 8. A position limiter 28 is integrally formed on an outer wall of the developer supplying box 1, and a chuck 30 matching the position limiter 28 is integrally formed on the first sliding cover 7, so as to realize the limiting and fixing of the first sliding cover 7.

As shown in FIGS. 1-4, a lower side of the first gear 3 is engaged with a second gear 10 to form a transmission connection, a lower side of the second gear 10 is engaged with a third gear 11 to form a transmission connection, a side of the third gear 11 is engaged with a fourth gear 12 to form a transmission connection, and a lower side of the fourth gear 12 is engaged with a fifth gear 13 to form a transmission connection. A screw feeding rod 14 is inserting into the fifth gear 13, and the screw feeding rod 14 is located in a middle portion inside the developer containing box 2. A powder waste inlet 20 is disposed on a side of the developer containing box 2 adjacent to the fifth gear 13, the second sliding cover 19 is slidably connected to an outer side of the powder waste inlet 20, and the second sliding cover 19 is disposed on the developer containing box 2, so as to facilitate the waste powder to enter the developer containing box 2.

As shown in FIG. 1, FIG. 2, FIG. 5, and FIG. 6, a sixth gear 21 is fixed to an end of the screw feed rod 14 away from the fifth gear 13, where the sixth gear 21 is located at an outer side of the developer containing box 2 and is rotatably connected to a side wall of the developer containing box 2. A side of the sixth gear 21 is engaged with a seventh gear 22 to form a transmission connection, and a side of the seventh gear 22 is engaged with an eighth gear 23 to form a transmission connection. A connecting rod 24 is fixed with the eighth gear 23, and a rocker arm 25 is fixed to an end of the connecting rod 24 away from the eighth gear 23. A detection cover 26 covers an outer side of the rocker arm 25, and the detection cover 26 is fixed to an outer wall of the developer containing box 2. A detection opening 27 is formed at an end of the detection cover 26. The rocker arm 25 will pass through the detecting hole 27 of the detecting cover 26 once during the eighth gear 23 drives the connecting rod 24 to rotate one cycle, thereby realizing the monitoring of the image forming device to the waste developer in the developer containing box 2.

The structural principle of the developer container is as follows: in the normal condition of the developer container, the first sliding cover 7 is in the left. At this time, the supply box powder outlet 9 and the sliding cover powder outlet 8 are staggered. In this situation, there is a confined space inside the developer supplying box 1. After the developer container is mounted on the image forming apparatus, the first sliding cover 7 is pushed to slide so that and the chuck 30 staggers from the position limiter 28. At this time, the first sliding cover 7 can be manually pushed toward the right so that the supply box powder outlet 9 overlaps the sliding cover powder outlet 8 so as to open the developer supplying box 1.

After the developer supplying box 1 is loaded, the first gear 3 engages with the gear(s) inside the image forming apparatus. The image forming apparatus drives the first gear 3 to rotate during being used, and the first gear 3 drives the rotating shaft 4 to rotate.

After the developer supplying box 1 is loaded, the second slider 19 is pushed to open by the mechanism of the image forming apparatus to expose the powder waste inlet 20. At this time, the waste developer generated in the image forming apparatus will enter the developer containing box 2 along the powder waste inlet 20. The first gear 3 drives the rotating shaft 4 while driving the second gear 10 to rotate, the second gear 10 drives the third gear 11, the third gear 11 drives the fourth gear 12, and the fourth gear 12 drives the fifth gear 13. Through a series of transmissions, the fifth gear 13 rotates counterclockwise, thereby driving the screw feed rod 14 in the developer containing box 2 to rotate counterclockwise, thereby collecting the waste developer of the image forming apparatus.

When the screw feed rod 14 rotates, it drives the sixth gear 21 to rotate, so that and the sixth gear 21 drives the seventh gear 22 to rotate, the seventh gear 22 drives the eighth gear 23 to rotate, the eighth gear 23 drives the connecting rod 24 to rotate, and then the connecting rod 24 drives the rocker arm 25 to rotate. The rocker arm 25 will pass through the detecting hole 27 of the detecting cover 26 once during rotating one cycle, thereby realizing the monitoring of the image forming device to the waste developer in the developer containing box 2.

It should be noted that, the forgoing is only embodiments of the present disclosure, which are not intended to limit the present disclosure. Although the present disclosure has been described in detail with reference to the foregoing embodiments, for those skilled in the art, modifications may be made to the technical schemes described in the above-mentioned embodiments, or some of the technical features may be equivalently replaced, while these modifications, equivalently replacements, improvements, or the like which are made within the spirit and principles of the present disclosure should all be included within the scope of the present disclosure.

What is claimed is:

1. A developer container, comprising:

a developer supplying box (1); and a developer containing box (2);

wherein, the developer supplying box (1) is inserted to fix at an upper end of the developer containing box (2); a first gear (3) is rotatably connected to an outer side of a side wall of the developer supplying box (1), and a rotating shaft (4) is inserted into the first gear (3); the rotating shaft (4) is located inside the developer supplying box (1), a plurality of first stirring blades (5) are fixedly connected to two sides of the rotating shaft (4) in a symmetrical manner, and a second stirring blade (6) is fixed at a middle portion of the rotating shaft (4); a first sliding cover (7) is sleeved on a middle portion of an outer side of the developer supplying box (1), and a sliding cover powder outlet (8) is disposed on a front side of the first sliding cover (7); a supply box powder outlet (9) is disposed on a middle portion of a front side of the developer supplying box (1) to match the sliding cover powder outlet (8); a lower side of the first gear (3) is engaged with a second gear (10) to form a transmission connection, a lower side of the second gear (10) is engaged with a third gear (11) to form a transmission connection, a side of the third gear (11) is engaged with a fourth gear (12) to form a transmission connection, and a lower side of the fourth gear (12) is engaged with a fifth gear (13) to form a transmission connection; a screw feeding rod (14) is inserting into the fifth gear (13), and the screw feeding rod (14) is located in a middle portion inside the developer containing box (2).

2. The developer container of claim 1, wherein an end of the rotating shaft (4) away from the first gear (3) is provided with a ring (15), a side cover (16) is rotatably connected with the ring (15), and the side cover (16) is fixed on an outer wall of the developer supplying box (1).

3. The developer container of claim 2, wherein a plug (17) is inserted into a middle portion of the side cover (16), a sealing ring (18) is sleeved on the plug (17), and the sealing ring (18) closely contacts with the side cover (16).

4. The developer container of claim 1, wherein a powder waste inlet (20) is disposed on a side of the developer containing box (2) adjacent to the fifth gear (13), the second sliding cover (19) is slidably connected to an outer side of the powder waste inlet (20), and the second sliding cover (19) is disposed on the developer containing box (2).

5. The developer container of claim 1, wherein a sixth gear (21) is fixed to an end of the screw feed rod (14) away from the fifth gear (13), the sixth gear (21) is located at an outer side of the developer containing box (2) and is rotatably connected to a side wall of the developer containing box (2), and a side of the sixth gear (21) is engaged with a seventh gear (22) to form a transmission connection, a side of the seventh gear (22) is engaged with an eighth gear (23) to form a transmission connection, a connecting rod (24) is fixed with the eighth gear (23), a rocker arm (25) is fixed to an end of the connecting rod (24) away from the eighth gear (23), a detection cover (26) covers an outer side of the rocker arm (25), the detection cover (26) is fixed to an outer wall of the developer containing box (2), and a detection opening (27) is formed at an end of the detection cover (26).

6. The developer container of claim 1, wherein a position limiter (28) is integrally formed on an outer wall of the developer supplying box (1), and a chuck (30) matching the position limiter (28) is integrally formed on the first sliding cover (7).

7. The developer container of claim 1, wherein an outer wall of the first sliding cover (7) is provided with anti-slip patterns (29) in an even manner.

8. The developer container of claim 1, wherein the first stirring blades (5) on the two sides of the rotating shaft (4) are symmetrically disposed to have included angles opposite with each other with respect to an axis of a body of the rotating shaft (4) between two corresponding first stirring blades (5), and the second stirring blade (6) is disposed parallel to the axis of the body of the rotating shaft (4).

* * * * *